US009279296B2

(12) United States Patent
Armstrong et al.

(10) Patent No.: US 9,279,296 B2
(45) Date of Patent: Mar. 8, 2016

(54) INJECTOR HEAD

(75) Inventors: Kenny Armstrong, Stavanger (NO); Morten Talgo, Sandnes (NO); Ole Johannessen, Stavanger (NO)

(73) Assignee: C6 Technologies AS, Stavanger (NO)

( * ) Notice: Subject to any disclaimer, the term of this patent is extended or adjusted under 35 U.S.C. 154(b) by 575 days.

(21) Appl. No.: 13/635,720

(22) PCT Filed: Mar. 18, 2011

(86) PCT No.: PCT/GB2011/000384

§ 371 (c)(1), (2), (4) Date: Nov. 20, 2012

(87) PCT Pub. No.: WO2011/114111

PCT Pub. Date: Sep. 22, 2011

(65) Prior Publication Data

US 2013/0112433 A1 May 9, 2013

(30) Foreign Application Priority Data

Mar. 18, 2010 (GB) ..... 1004481.6

(51) Int. Cl.
*E21B 19/08* (2006.01)
*E21B 19/22* (2006.01)
*E21B 33/072* (2006.01)

(52) U.S. Cl.
CPC ..... *E21B 19/08* (2013.01); *E21B 19/22* (2013.01); *E21B 33/072* (2013.01)

(58) Field of Classification Search
USPC ..... 166/385, 66.4, 77.3
See application file for complete search history.

(56) References Cited

U.S. PATENT DOCUMENTS

| | | | | |
|---|---|---|---|---|
| 4,655,291 | A | 4/1987 | Cox | |
| 5,244,046 | A * | 9/1993 | Council et al. | 166/380 |
| 6,189,609 | B1 * | 2/2001 | Shaaban et al. | 166/77.3 |
| 6,230,955 | B1 * | 5/2001 | Parks | 226/190 |
| 6,450,385 | B1 * | 9/2002 | Guerin | 226/89 |
| 2003/0155127 | A1 * | 8/2003 | Carlsen | 166/368 |
| 2003/0209346 | A1 | 11/2003 | Austbo et al. | |
| 2004/0094306 | A1 * | 5/2004 | Goode et al. | 166/339 |
| 2008/0302530 | A1 * | 12/2008 | Shampine | E21B 33/068 166/250.08 |

OTHER PUBLICATIONS

International Search Report corresponding to International Application No. PCT/GB2011/000384 mailed Mar. 9, 2012.
Written Opinion of the International Searching Authority corresponding to International Application No. PCT/GB2011/000384.

* cited by examiner

*Primary Examiner* — Taras P Bemko
(74) *Attorney, Agent, or Firm* — Myers Bigel & Sibley

(57) ABSTRACT

An injector head for feeding a tool string support member downhole is described. The injector head includes a first gripping device and a second gripping device. The first and second gripping devices are adapted to grip a tool string support member passing through an injector head passageway. The injector head further includes an actuator movable between a first position and a second position wherein, movement of the actuator between the first and second positions moves at least a portion of both of the first and second gripping devices towards or away from a passageway longitudinal axis.

44 Claims, 6 Drawing Sheets

INJECTOR HEAD

RELATED APPLICATIONS

This application is a 35 §371 national stage application of PCT Application No. PCT/GB2011/000384, filed on Mar. 18, 2011, which claims priority from British Application No. 1004481.6 filed on Mar. 18, 2010, the contents of which are incorporated herein by reference in their entireties. The above-referenced PCT International Application was published as International Publication No. WO 2011/114111 A2 on Sep. 22, 2011.

FIELD OF THE INVENTION

The present invention relates to an injector head and a method of using an injector head.

BACKGROUND TO THE INVENTION

Downhole tools and equipment are run downhole on support members such as cables or coiled steel tubing. These support members, together with the tools or equipment that they support, are forced downhole using equipment such as an injector head.

An injector head is conventionally used to feed coiled steel tubing from surface down a hydrocarbon well. An injector head consists of a pair of opposed chains between which the coiled tubing is sandwiched. The chains are fitted with rubber blocks in an arrangement like a tank track. Each chain and rubber block arrangement is wrapped around a pair of cogs, one or both of the cogs being driven. The rubber blocks grip the coiled tubing and as the chains rotate in opposite directions about the cogs, the coiled tubing is pushed downhole.

Conventional injector heads have drawbacks however. Quite often the coiled tubing is not centred in the injector head causing one chain to apply a greater pressure than the other chain resulting in wear on one of the chains.

Additionally, chains are expensive and difficult to maintain, requiring constant lubrication with the associated potential for environmental damage. In the event of failure of the chains, significant downtime can result.

SUMMARY OF THE INVENTION

According to a first aspect of the present invention there is provided an injector head for feeding a tool string support member downhole, the injector head comprising:

a first gripping device;

a second gripping device, the first and second gripping devices adapted to grip a toot string support member passing through an injector head passageway;

an actuator movable between a first position and a second position;

wherein, movement of the actuator between the first and second positions moves at least a portion of both of the first and second gripping devices towards or away from a passageway longitudinal axis.

In at least one embodiment of the present invention, an injector head is provided in which movement of a single actuator results in movement of both gripping devices. This allows, in use, for even pressure to be applied to a tool string support member passing through the injector head passageway and assists in centralising the support member in the injector head and, subsequently, on entry into, for example, a riser.

The support member may be a cable.

The cable may be wireline or slickline.

The cable may be a composite cable.

The support member may be a tubular, such as a steel tubular or a composite tubular.

The support member may be a rod.

The rod may be a composite rod.

The support member may be reelable.

In one embodiment, the gripping device portions are adapted to move along an axis perpendicular to the passageway longitudinal axis.

The gripping device portions may be adapted to move in a first plane, the passageway longitudinal axis lying on said first plane.

In an embodiment, the actuator first position and second position lie on an axis parallel to the passageway longitudinal axis.

The actuator first and second positions may lie on a second plane, the passageway longitudinal axis lying on said second plane, the second plane being perpendicular to the first plane.

In one embodiment, movement of the actuator along an axis parallel to the passageway longitudinal axis is translated into movement of the gripping devices along an axis perpendicular to the passageway longitudinal axis.

In an embodiment, the linear distance of travel of the actuator may result in a non-equal linear distance of travel of the gripping device portions.

The linear distance of travel of the actuator may result in a reduced linear distance of travel of the gripping device portions. An arrangement in which the linear distance of travel of the actuator results in a reduced linear distance of travel of the gripping device portions can result in a greater force being applied by the gripping device portions to the support member.

Particularly, the vertical distance moved by the actuator may be greater than the horizontal distance moved by each of the gripping device portions.

The actuator may be a piston.

Alternatively, the actuator may be a roller screw.

In further alternatives the actuator may be a ball screw or power screw.

The actuator may be electrically powered.

Alternatively, the actuator may be hydraulically powered.

In one embodiment, the piston may be an electrically powered piston. In an alternative embodiment, the piston may be a hydraulic piston.

Each gripping device may comprise a support member engagement device and a pressure application device.

In one embodiment, the gripping device portion moved by the actuator comprises the pressure application device.

In use, each pressure application device may be adapted to press a support member engagement device into engagement with a support member passing through the injector head passageway.

The pressure application devices may be opposed.

The pressure application devices may lie on opposite sides of the passageway.

The minimum width of the passageway may be defined by the distance between the support member engagement devices.

Each support member engagement device may be adapted to move with respect to the pressure application device with which it is associated.

Each support member engagement device may be adapted to rotate around the pressure application device with which it is associated.

In use, when engaged with a support member, each support member engagement device moves in the direction of travel of the support member. Particularly, a surface of the support member engagement device, which is engaged with the support member, moves in the direction of travel of the support member.

Each support member engagement device may be a belt, the belt may be endless.

The belt may be a toothed belt. Belts provide a continuous gripping surface and are resistant to stretching. Additionally high friction surfaces can be applied to resist slippage of the support member when it is being run into a well through the injector head.

In a further embodiment, the pressure application device may comprise a toothed belt.

In this embodiment, the pressure application device toothed belt may be adapted to engage the support member engagement device toothed belt.

The pressure application device toothed belt may be inverted. In this embodiment, the toothed belt is fitted to the pressure application device with the toothed surface facing outwards.

The toothed surface of the pressure application device toothed belt may engage the toothed surface of the support member engagement device toothed belt. In this case, the inverted toothed belt associated with the pressure application device engages the toothed surface of the support member engagement device toothed belt.

A toothed external surface of the application device belt may engage a taste internal surface of the engagement device toothed belt. Such an arrangement provides a more continuous support and constant gripping force to the support member.

Alternatively, each support member engagement device may be a chain, the chain including elements for gripping a support member, such as rubber blocks.

Each gripping device may further comprise at least one driving means adapted to move a support member engagement device with respect to the pressure application device.

The driving means may comprise at least one driven member.

Each driven member may be adapted to releasably engage a support member engagement device.

There may be a plurality of driving means.

The driving means may comprise a first and a second wheel for engaging with the support member engagement device. One of said wheels may be externally driven by, for example, electrical or hydraulic power. The other of said wheels may be a follower.

Where the support member engagement device is a toothed belt, the first and second wheels may be toothed pulleys.

Where the support member engagement device is a chain, the first and second wheels maybe cogs.

Each pressure application device may comprise a contact surface for contacting the support member engagement device.

Each contact surface may be parallel to the passageway longitudinal axis.

The first gripping device contact surface may be parallel to the second gripping device contact surface.

Each support member engagement device may be adapted to slide over a pressure application device contact surface.

Each contact surface may be low friction.

In one embodiment, each contact surface may comprise a plurality of bearings. Bearings provide a low fiction surface.

The bearings may be roller bearings or needle bearings.

The bearings may be arranged in rows, each row being parallel to the passageway longitudinal axis.

Where the bearings are arranged in rows, the diameter of each bearing maybe less than the width of each row.

Each bearing row may comprise a plurality of bearings. Such an arrangement allows for multiple contact points between the bearings and the support member engagement device, allowing for an improved grip on the support member.

Each bearing in each row may rotate about an axis perpendicular to the row longitudinal axis.

Each bearing rotation axis may be parallel to the rotation axes of the bearings in at least one of the row or rows immediately adjacent. Having each rotation axis offset from the rotation axes of the bearings in the row or rows immediately adjacent allows for a more continuous gripping surface across the width of the contact surface, particularly if the diameter of the bearings is relatively small. If the bearings in the adjacent rows all shared the same axis then there would be peaks and troughs extending across the width of the contact surface.

The contact surface may be concave across its width. Such an arrangement may improve the grip can apply to the support member.

The injector head may further comprise a transfer mechanism to transfer movement of the actuator to the pressure application devices.

According to a second aspect of the present invention there is provided a method of feeding a tool string support member downhole, the method comprising the steps of:

moving an actuator from the first position to a second position, movement of the actuator moving at least a portion of a first gripping device and at least a portion of a second gripping device into engagement with a tool string support member; and driving said first and second gripping devices to feed the said tool string support member downhole.

According to a third aspect of the present invention there is provided a pressure application device for applying a pressure to a tool string engagement device, the pressure application device comprising:

a body defining a surface; and a plurality of bearings, mounted to a surface of the plate, the bearings being arranged in rows each bearing rotating about a rotation axis, the rotation axis of one bearing being parallel to the rotation axes of the bearings in at least one of the row or rows immediately adjacent.

It will be understood that preferred features of the first aspect may be equally applicable to the second or third aspect and have not been repeated for brevity.

BRIEF DESCRIPTION OF THE DRAWINGS

Embodiments of the present invention will now be described with reference to the accompanying Figures in which:

FIG. 4, comprising

DETAILED DESCRIPTION OF THE DRAWINGS

Figure 1:
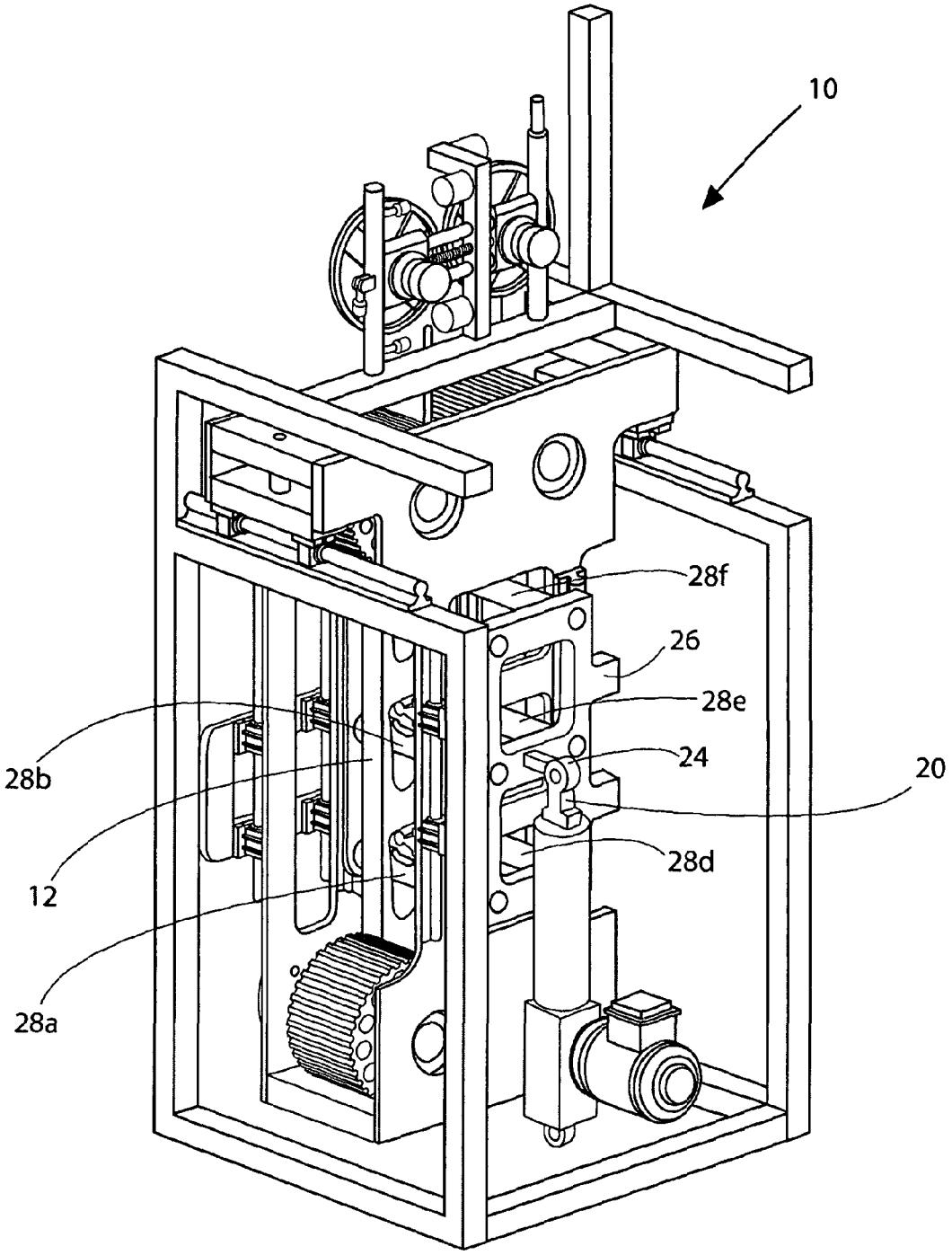
FIG. 1 is a perspective view of an injector head for feeding a cable downhole according to a first embodiment of the present invention.
Figure 2:
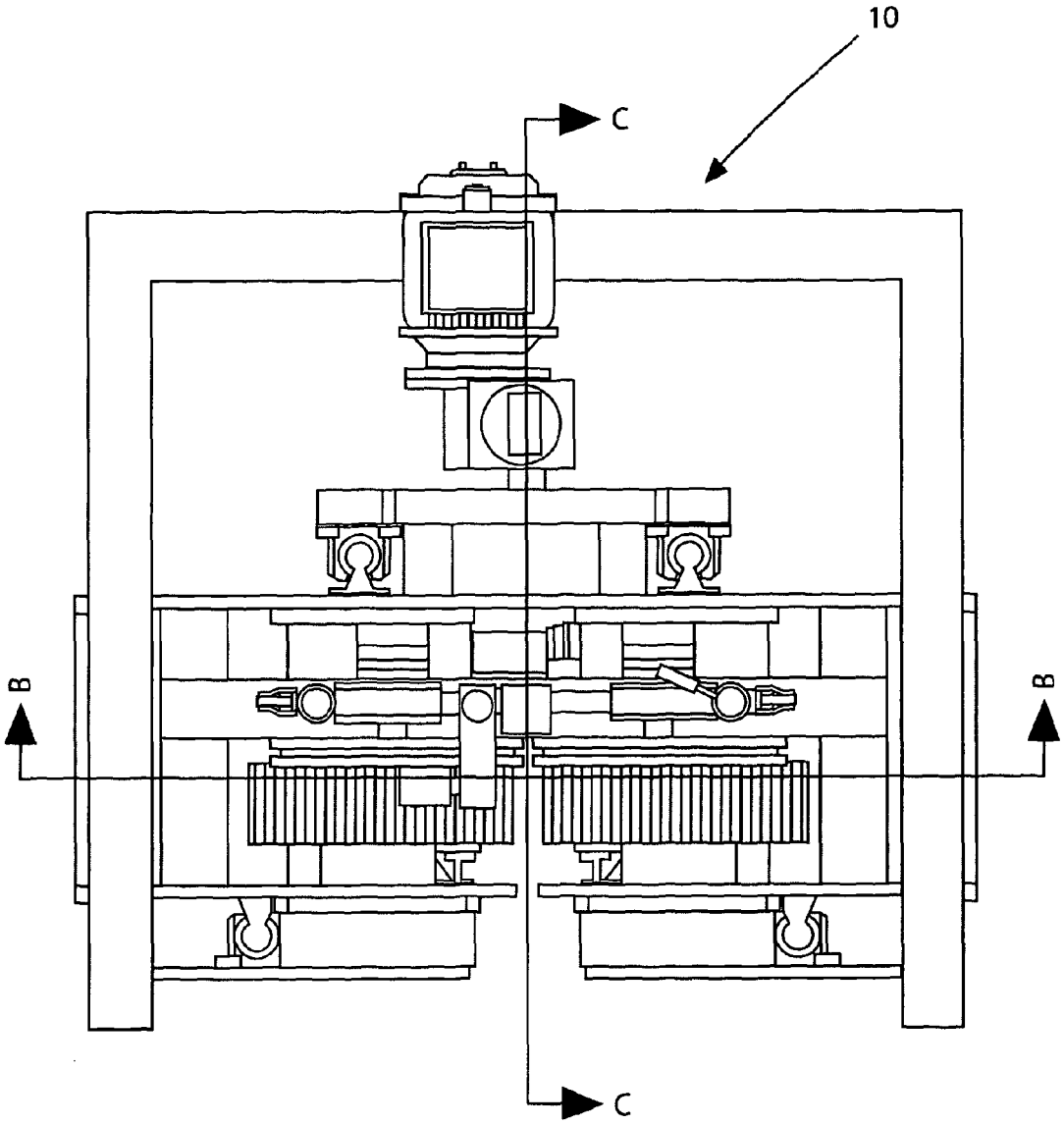
FIG. 2 is a top view of the injector head of FIG. 1.

Reference is firstly made to FIG. 1, a perspective view of an injector head, generally indicated by reference numeral 10, for feeding a cable 16 downhole; FIG. 2, a top view of the injector head 10 of FIG. 1; and FIG. 3 a section view through line B-B on FIG. 2.

The injector head 10 comprises a first gripping device 12 (most clearly seen in FIG. 3), and a second gripping device 14, the first and second gripping devices 12, 14 adapted to grip a cable 16 passing through an injector head passageway 18. The injector head 10 further comprises an actuator 20 (best seen in FIG. 1). The actuator 20 is moveable between a first position in which the gripping devices 12, 14 are engaged with the cable 16 and a second position in which the gripping devices 12, 14 are disengaged from the cable 16.

Figure 3:
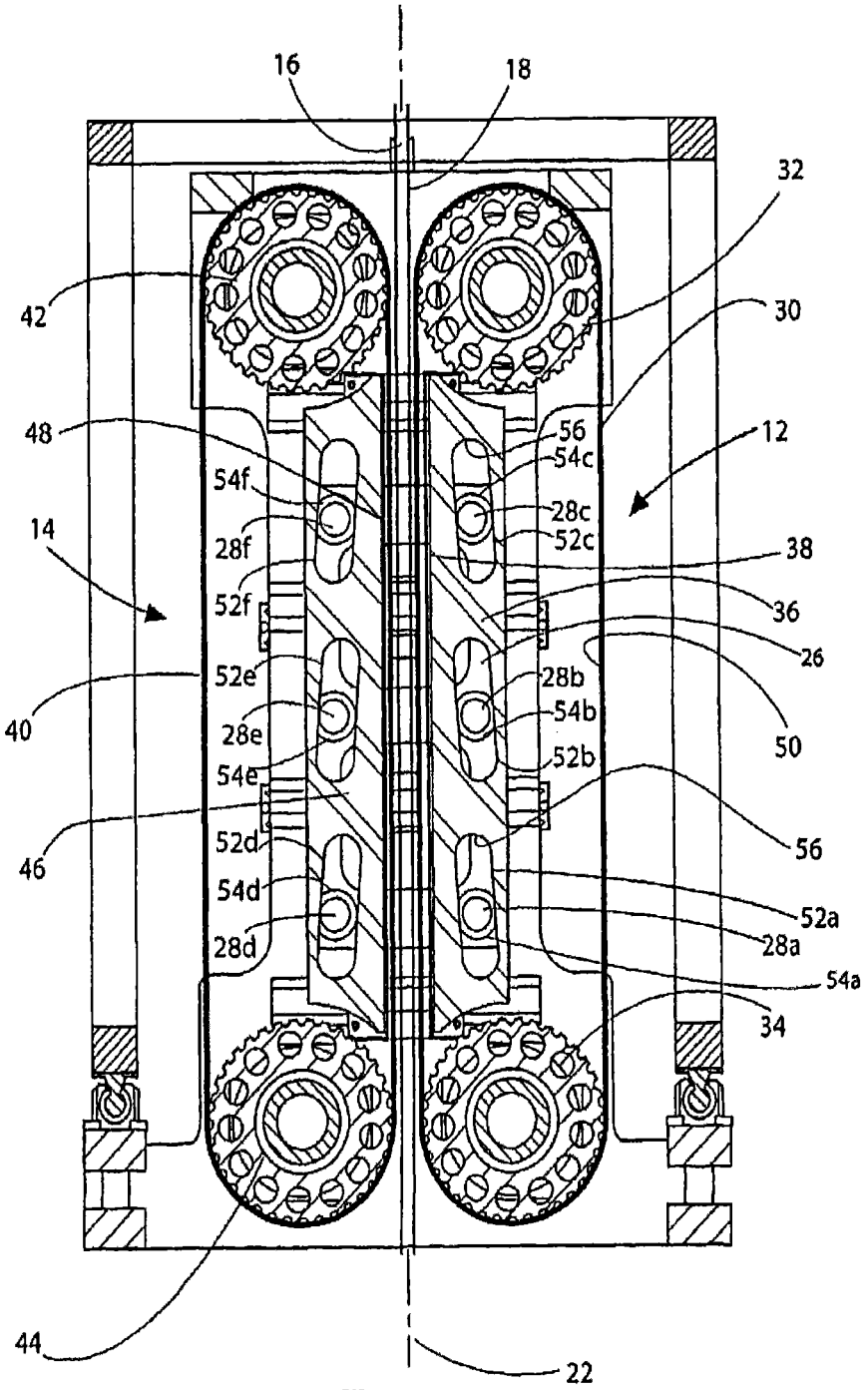
FIG. 3 is a section along line B-B on FIG. 2.

Referring to FIG. 3, the first gripping device 12 comprises a cable engagement device 30, in the form of an endless toothed belt, first and second pulleys 32, 34 for driving the belt 30, and a pressure application device 36 comprising a pressure application surface 38 adapted to engage a belt internal surface 50 and push the belt 30 into engagement with the cable 16.

The second gripping device 14 comprises a belt 40, first and second pulleys 42, 44, and a pressure application device 46 defining a pressure application surface 48.

Movement of the actuator 20 from the first position to the second position moves the first and second pressure application devices 36, 46 from an engaged configuration in which each pressure application device 36, 46 is engaged with its respective belt internal surface 50, to a fully disengaged configuration in which each pressure application device 36, 46 is disengaged from its respective belt internal surface 50. In this embodiment, movement of a single actuator 20 results in equal movement of the pressure application devices 36, 46 simultaneously. This assists in centring the cables 16 in the injector head passageway 18 resulting in minimal wear on the gripping devices 12, 14.

Referring back to FIG. 1, the actuator 20 is an electrically powered piston which moves in a vertical direction parallel to, and co-planar with, the injector head passageway longitudinal axis 22. The actuator 20, comprises an engagement device 24 adapted to engage an actuator plate 26. Attached to the actuator plate 26 are five actuator rods 28*a-f* (partly visible on FIG. 1 or clearly visible on FIG. 3).

Figure 4C:
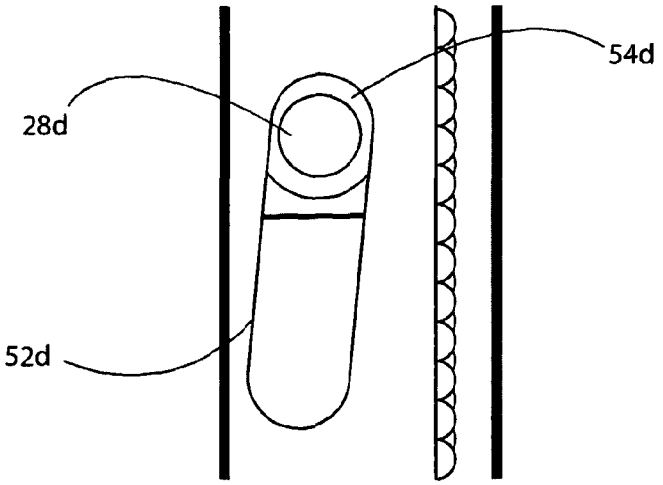
FIGS. 4*a* to 4*c* is a series schematic of the movement of part of the second pressure application device of the injector head of FIG. 1 from an engaged position (FIG. 4*a*) to a fully disengaged position (FIG. 4*c*)

Referring to FIG. 3, each of the actuator rods 28 passes through an aperture 52*a-f* defined by one of the pressure application devices 36, 46. Each actuator rod 28 comprises a bearing 54*a-f* which engages an internal surface 56 of each pressure application device aperture 52. As the actuator 20 moves between the first and second positions, so the actuator plate 26 and actuator rods 28 move as well. As the actuator rods 28 move parallel to the cable 16 and the longitudinal axis 22, they engage the internal surfaces 56 of the gripping device apertures 52*a-f*. As can be seen from FIG. 3, the apertures 52 are angled with respect to the longitudinal axis 22 and as the actuator rods 28 move from the bottom of each aperture 52 to the top of each aperture 52, the pressure application devices 36, 46 move away from the cable 16. This is most clearly seen in FIGS. 4*a-c*, a schematic of the movement of the part of the second pressure application device 46 from an engaged position, shown in FIG. 4*a* to a fully disengaged position shown in FIG. 4*c* as the actuator (not shown) moves from the first position to the second position. During movement of the actuator, the visible actuator rod 28*d* moves from the bottom of the aperture 52*d* to the top of the aperture 52*d*. In doing so the actuator rod bearing 54*d* engages with the aperture internal surface 56 and pulls the pressure application device engagement surface 48 away from engagement with the belt 40. As the gripping device apertures 52*a-f* are at an angle a (FIG. 4*b*), a being less than 45° to the direction of travel of the actuator rod 28, the vertical distance moved by the rod 28 is greater than the horizontal distance moved by the pressure application devices 36, 46 towards or away from the belt 40. This allows a greater pressure to be applied by the pressure application devices 36, 46 to the cable 16.

Figure 4B:
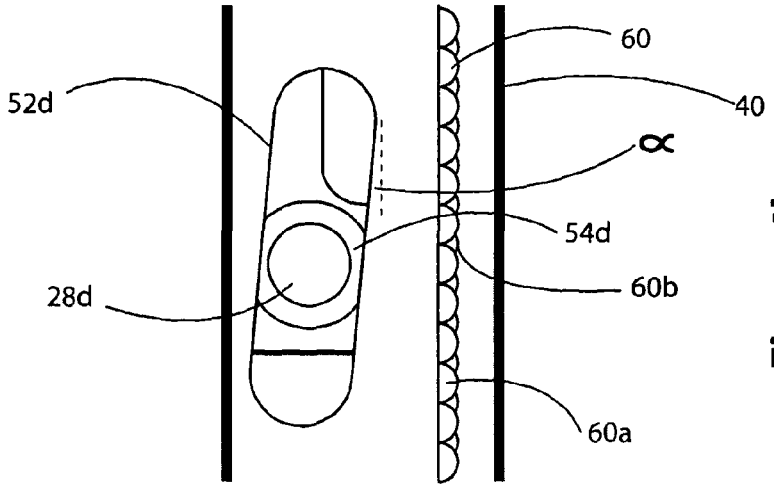
Figure 4A:
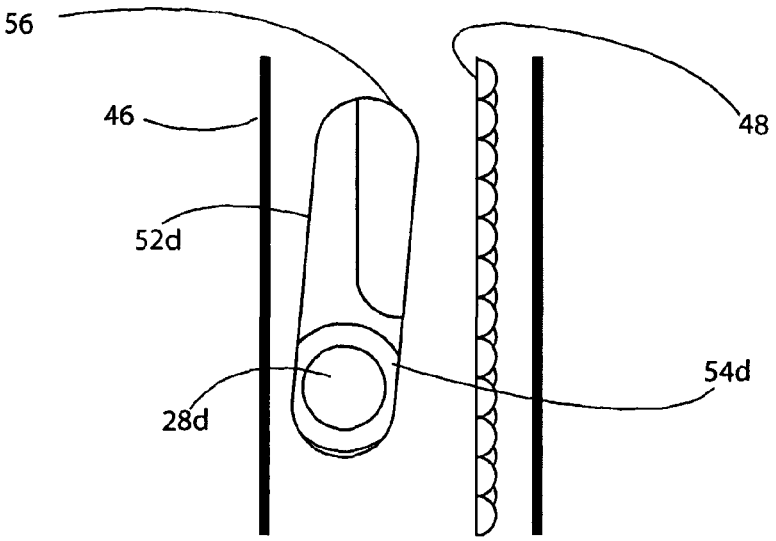
Figure 5:
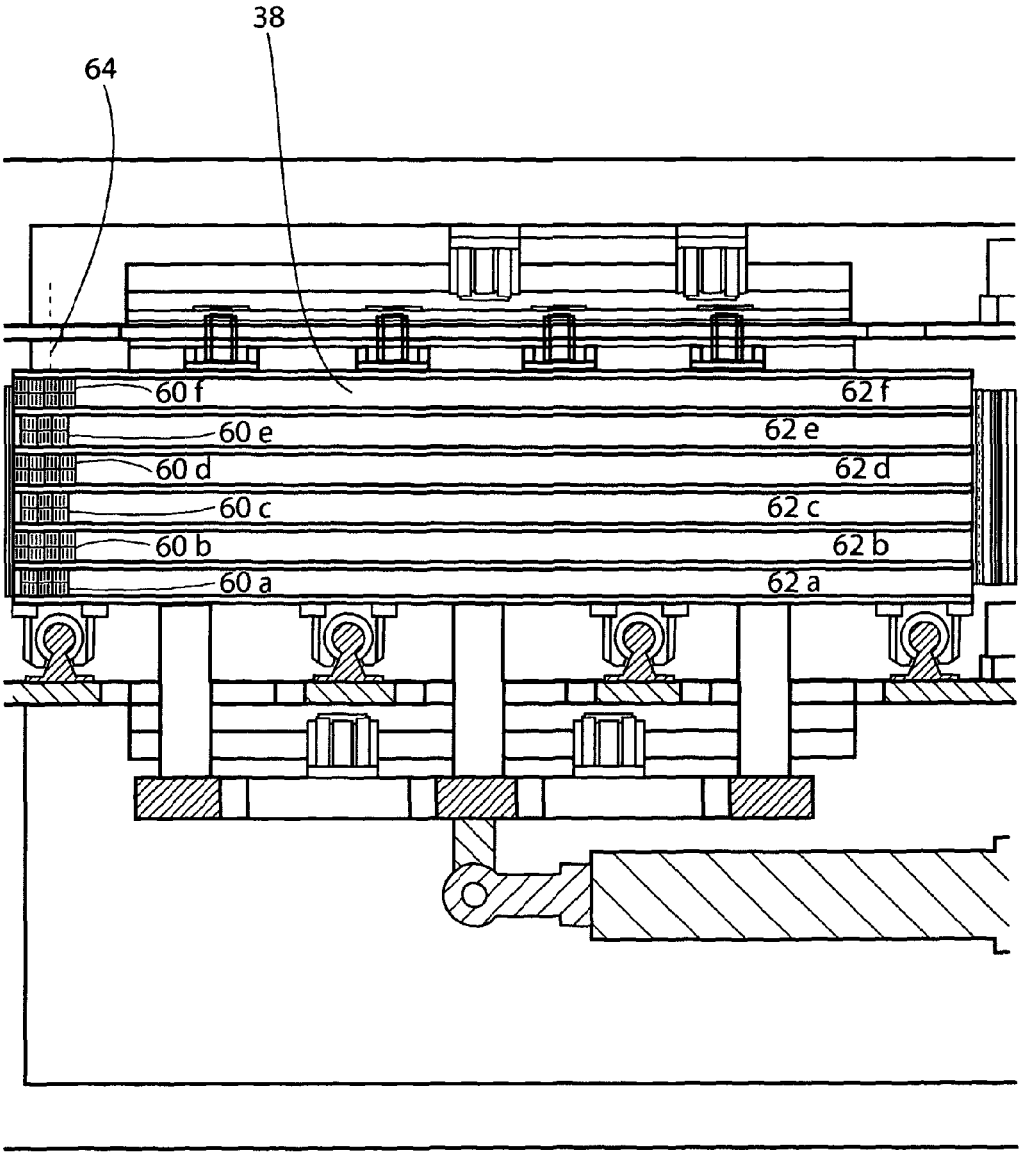
FIG. 5 is a section along line C-C on FIG. 2.

The pressure application device engagement surfaces 38, 48 are defined by rows of needle bearings 60 (FIG. 4*b*). As can be seen from FIG. 4*b* there a number of rows of bearings 60 mounted to the pressure application device 46. Referring to FIG. 5, a section view along line C-C on FIG. 2, the arrangement of the first pressure application device surface 38 is shown. The surface 38 is defined by six channels 62*a-f*, each channel 62 containing a column of needle bearings 60. Only the first three bearings 60 in each column are shown for clarity.

The rotation axis 64 of each bearing 60 is offset from the rotation axes of bearings 60 in adjacent channels 62. The effect of offsetting adjacent channels 62 of bearings 60 is to provide a surface 38, 48 which is supportive across its width.

Operation of the injector head 10 will now be described. The cable 16 is passed through the injector head passageway 18 and the actuator 20 is moved from the second position to the first position. Movement of the actuator 20 from the second to the first positions, moves the pressure application devices 36, 46 into engagement with the belts 30, 40, the belts 30, 40 in turn engaging the cable 16. Once engaged with the cable 16, the upper belt pulleys 32, 42 are driven in opposite directions by pulley motors (not shown), the pulleys 32, 42 driving the belts 30, 40. As the belts 30, 40 and the cable 16 are compressed between the pressure application devices 36, 46, the movement of the belts 30, 40 feeding the cable 16 downhole.

Figure 6:
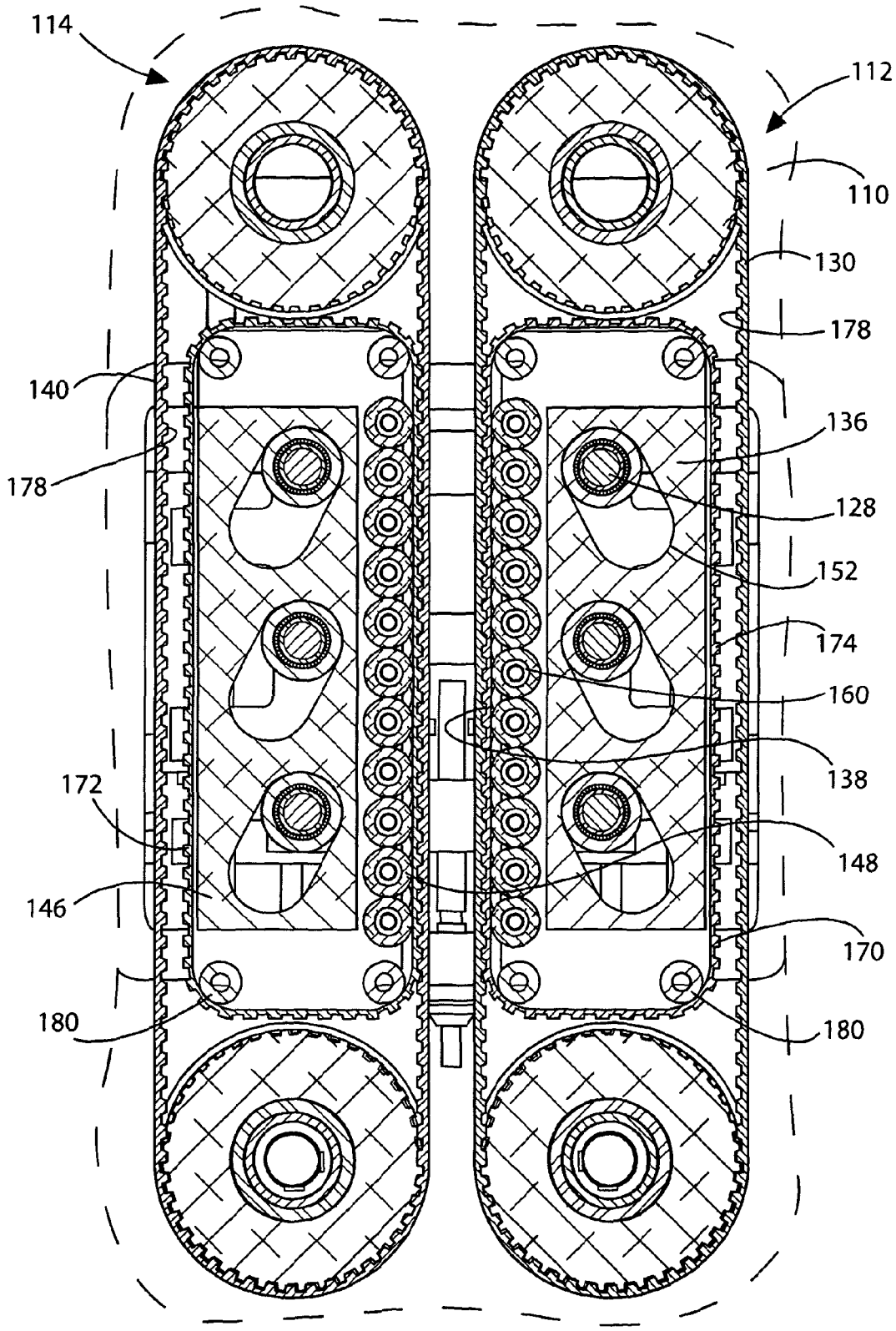
FIG. 6 is a section of an injector head for feeding a cable downhole according to a second embodiment of the present invention.

Reference is now made to FIG. 6, a section of an injector head 110 according to a second embodiment of the present invention. This injector head 110 is largely the same as the injector head 10 of the first embodiment. The key difference is the provision of first and second pressure application device belts 170, 172. Each belt 170, 172 defines an outwardly facing tooth surface 174 which is complimentary and is adapted to engage the inwardly facing tooth surface 176, 178 of the first and second cable engagement belts 130, 140. The purpose of the pressure application device belts 170, 172 is to provide a more even transmission of the pressure being applied by the pressure application device through the bearings 160. Such an arrangement permits larger bearings 160 to be used in preference to the needle bearings 60 of the first embodiment. The pressure application device belts 170, 172 prevent the peaks and troughs type application of the force applied by the pressure application devices 136, 146 which may be created where larger bearings are used. The arrangement shown in FIG. 6 lends itself to transmitting the maximum force available over the length of the belts. The pressure application device belts 170, 172 are not driven, they merely rotate around a respective set of forebearings 180, 182. The rotation pf the pressure application device belts 170, 172 being provided by the driven belts 130, 140 have the gripping devices 112, 114.

Various modifications and improvements may be made to the above described embodiments without departing from the scope of the present invention. For example, although the embodiments described relate to feeding the cable downhole, the apparatus could equally be used to feed coiled tubing downhole.

The invention claimed is:

1. An injector head for feeding a tool string support member downhole, the injector head comprising:

a first gripping device;

a second gripping device, the first and second gripping devices adapted to grip a tool string support member passing through an injector head passageway; and an actuator movable between a first position and a second position, wherein, movement of the actuator between the first and second positions moves at least a portion of both of the first and second gripping devices towards or away from a passageway longitudinal axis, and wherein the linear distance of travel of the actuator results in a non-equal linear distance of travel of the gripping device portions.

2. The injector head of claim 1, wherein the first and second gripping devices each comprise a support member engagement device that comprises a belt.

3. The injector head of claim 2, wherein the support member comprises a composite cable.

4. The injector head of claim 2, wherein the support member comprises a composite tubular.

5. The injector head of claim 2, wherein the support member comprises a composite rod.

6. The injector head of claim 2, wherein the support member is reelable.

7. The injector head of claim 2, wherein the gripping device portions are adapted to move along an axis perpendicular to the passageway longitudinal axis.

8. The injector head of claim 2, wherein the gripping device portions are adapted to move in a first plane, the passageway longitudinal axis lying on said first plane.

9. The injector head of claim 8, wherein the actuator first position and second position lie on an axis parallel to the passageway longitudinal axis.

10. The injector head of claim 9, wherein the actuator first and second positions lie on a second plane, the passageway longitudinal axis lying on said second plane, the second plane being perpendicular to the first plane.

11. The injector head of claim 2, wherein the movement of the actuator along an axis parallel to the passageway longitudinal axis is translated into movement of the gripping devices along an axis perpendicular to the passageway longitudinal axis.

12. The injector head of claim 2, wherein the actuator is a piston.

13. The injector head of claim 2, wherein the actuator is electrically powered.

14. The injector head of claim 2, wherein each gripping device comprises the support member engagement device and a pressure application device.

15. The injector head of claim 14, wherein the gripping device portion moved by the actuator comprises the pressure application device.

16. The injector head of claim 15, wherein, in use, each pressure application device is adapted to press a respective support member engagement device into engagement with a support member passing through the injector head passageway.

17. The injector head of claim 14, wherein the pressure application devices are opposed.

18. The injector head of claim 17, wherein the pressure application devices lie on opposite sides of the passageway.

19. The injector head of claim 18, wherein a minimum width of the passageway is defined by the distance between the support member engagement devices.

20. The injector head of claim 14, wherein each support member engagement device is adapted to move with respect to the pressure application device with which it is associated.

21. The injector head of claim 20, wherein each support member engagement device is a belt, the belt being endless and toothed.

22. The injector head of claim 14, wherein each gripping device further comprises at least one driving means adapted to move a support member engagement device with respect to the pressure application device.

23. The injector head of claim 22, wherein the driving means comprises at least one driven member.

24. The injector head of claim 23, wherein each driven member is adapted to releasably engage a support member engagement device.

25. The injector head of claim 22, comprising a plurality of driving means.

26. The injector head of claim 22, wherein the driving means comprises a first and a second wheel for engaging with the support member engagement device.

27. The injector head of claim 26, wherein where the support member engagement device is a toothed belt, the first and second wheels are toothed pulleys.

28. The injector head of claim 14, wherein each pressure application device defines a contact surface for contacting the support member engagement device.

29. The injector head of claim 28, wherein each contact surface is parallel to the passageway longitudinal axis.

30. The injector head of claim 28, wherein the first gripping device contact surface is parallel to the second gripping device contact surface.

31. The injector head of claim 28, wherein each support member engagement device is adapted to slide over a pressure application device contact surface.

32. The injector head of claim 31, wherein each pressure application device comprises a plurality of bearings.

33. The injector head of claim 32, wherein the plurality of bearings define the contact surface.

34. The injector head of claim 33, wherein the bearings are arranged in rows, each row being parallel to the passageway longitudinal axis.

35. The injector head of claim 31, wherein each pressure application device comprises a toothed belt and defines the contact surface.

36. The injector head of claim 28, wherein the contact surface is concave across its width.

37. The injector head of claim 2, wherein the injector head further comprises a transfer mechanism to transfer movement of the actuator to the pressure application devices.

38. The injector head of claim 2, wherein each belt comprises an endless toothed belt.

39. The injector head of claim 1, wherein the linear distance of travel of the actuator results in a reduced linear distance of travel of the gripping device portions.

40. The injector head of claim 39, wherein the vertical distance moved by the actuator is greater than the horizontal distance moved by each of the gripping device portions.

41. An injector head for feeding a tool string support member downhole, the injector head comprising:

a first gripping device;

a second gripping device, the first and second gripping devices adapted to grip a tool string support member passing through an injector head passageway; and an actuator movable between a first position and a second position, wherein, movement of the actuator between the first and second positions moves at least a portion of both of the first and second gripping devices towards or away from a passageway longitudinal axis, wherein each gripping device comprises a support member engagement device and a pressure application device, wherein each support engagement device is adapted to move with respect to the pressure application device with which it is associated, and wherein each support member engagement device is adapted to rotate around the pressure application device with which it is associated.

42. An injector head for feeding a tool string support member downhole, the injector head comprising:

a first gripping device;

a second gripping device, the first and second gripping devices adapted to grip a tool string support member passing through an injector head passageway; and an actuator movable between a first position and a second position, wherein, movement of the actuator between the first and second positions moves at least a portion of both of the first and second gripping devices towards or away from a passageway longitudinal axis, wherein each gripping device comprises a support member engagement device and pressure application device, wherein each pressure application device defines a contact surface for contacting the support member engagement device, wherein each support member engagement device is adapted to slide over a pressure application device contact surface, wherein each pressure application device comprises a plurality of bearings, the plurality of bearings defining the contact surface, the bearings being arranged in rows, each row being parallel to the passageway longitudinal axis, and where the bearings are arranged in rows, the diameter of each bearing is less than the width of each row.

43. The injector head of claim 42, wherein each bearing in each row rotates about an axis perpendicular to the row longitudinal axis.

44. The injector head of claim 43, wherein each bearing rotation axis is parallel to the rotation axes of the bearings in at least one of the row or rows immediately adjacent.

* * * * *